US007885588B2

(12) United States Patent
Katoh et al.

(10) Patent No.: US 7,885,588 B2
(45) Date of Patent: Feb. 8, 2011

(54) TRANSFER ASSEMBLY AND IMAGE FORMING APPARATUS INCLUDING SAME

(75) Inventors: Tsutomu Katoh, Kawasaki (JP); Kazuosa Kuma, Yokohamashi (JP); Takeshi Fukao, Yokohamashi (JP); Yoshiharu Kishi, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 570 days.

(21) Appl. No.: 11/943,941

(22) Filed: Nov. 21, 2007

(65) Prior Publication Data

US 2008/0175619 A1 Jul. 24, 2008

(30) Foreign Application Priority Data

Nov. 21, 2006 (JP) ..... 2006-314800
Jul. 5, 2007 (JP) ..... 2007-177707

(51) Int. Cl.
*G03G 15/01* (2006.01)
*G03G 15/08* (2006.01)

(52) U.S. Cl. ..... 399/302; 399/121; 399/299; 399/303

(58) Field of Classification Search ..... 399/302, 399/303, 121, 299
See application file for complete search history.

(56) References Cited

U.S. PATENT DOCUMENTS 7,274,897 B2 9/2007 Katoh
2004/0234287 A1* 11/2004 Nishida et al. ..... 399/66
2006/0067744 A1* 3/2006 Shin et al. ..... 399/302
2006/0067745 A1* 3/2006 Yamada et al. ..... 399/302
2006/0210307 A1 9/2006 Katoh et al.
2006/0210324 A1 9/2006 Kuma et al.
2006/0284958 A1 12/2006 Saeki et al.
2007/0098472 A1 5/2007 Saeki et al.
2007/0127947 A1 6/2007 Kuma et al.
2007/0127955 A1 6/2007 Katoh et al.

FOREIGN PATENT DOCUMENTS

JP 2002-40753 2/2002
JP 2005-266269 9/2005
JP 2008122596 A * 5/2008

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

An image forming apparatus includes a plurality of image carriers and a transfer assembly. The transfer assembly includes a plurality of transferees, a supporter, and a plurality of transferee holders. The plurality of transferers is each configured to electrostatically transfer a toner image carried on one of the image carriers onto an intermediate transfer member or a recording medium. The supporter is configured to support the transferers. The transferer holders are each configured to hold one of the transferers. Each of the transferee holders and the transferer held thereby form an integrated individual unit independently attachable to and detachable from the supporter.

12 Claims, 10 Drawing Sheets

TRANSFER ASSEMBLY AND IMAGE FORMING APPARATUS INCLUDING SAME

CROSS-REFERENCE TO RELATED APPLICATIONS

This patent specification claims priority from Japanese Patent Application Nos. JP2006-314800, filed on Nov. 21, 2006, and JP2007-177707, filed on Jul. 5, 2007 in the Japan Patent Office, the entire contents of each of which are hereby incorporated by reference herein.

BACKGROUND OF THE INVENTION

1. Field of the Invention

The present invention generally relates to a transfer assembly used in an electronographic tandem image forming apparatus including a laser printer, an LED (light-emitting diode) printer, a facsimile machine, etc., and an electronographic tandem image forming apparatus including the transfer assembly.

2. Discussion of the Background

In recent years, tandem image forming apparatuses have attracted attention as color image forming apparatuses because there is a need to output full color images as fast as a speed with which monochrome images are output.

Tandem image forming apparatuses include a plurality of photoreceptors and a transfer assembly including a plurality of transferers and an intermediate transfer belt or a transfer and transport belt. A different color image is formed on each of the photoreceptors. Two method are used to transfer images on the photoreceptors, a direct transfer belt method and an intermediate transfer belt method.

In the direct transfer belt method, the images are transferred sequentially by transferers and superimposed one on another directly onto a recording medium that is transported by a transfer and transport belt. In the intermediate transfer method, the images are transferred sequentially by transferees and superimposed one on another on an intermediate transfer belt, and then the superimposed image is transferred by a secondary transferee onto the recording medium. In both methods, the transferees in the transfer assembly are facing one of the photoreceptors via the transfer and transport belt or the intermediate transfer belt.

Although transferees typically include a conductive rubber or a conductive sponge material, which deteriorates over time, compatibility thereof is rarely considered because useful life thereof is longer than that of the intermediate transfer belt or the transfer and transport belt included in the transfer assembly together with the transferees.

Further, when a transferer including a conductive rubber or a conductive sponge material is touched by hand during maintenance work, the transferer may be stained, deformed, or damaged. Although an axis of the transferee can be touched, the axis is typically unexposed.

Image forming apparatuses typically manage the useful life of the transfer assembly based on usage history thereof, such as the number of sheets printed, and do not manage the useful life of the transferees included therein individually.

In a related-art image forming apparatus, transfer rollers are held in sub-frames in a transfer belt assembly as shown in FIG. 1. In FIG. 1, a transfer belt assembly 300 includes a transfer belt 301 stretched around a driving roller 310 to rotate the transfer belt 301, a tension roller 320 to apply tension to the transfer belt 301, and driven rollers 330 and 340. The transfer belt assembly 300 further includes a black sub-frame 350, in which a transfer roller 370 for black is attached, and a full-color sub-frame 360, in which three transfer rollers 370 are attached. In both the black sub-frame 350 and the full-color sub-frame 360, each transfer roller 370 is located at a position to contact a photoreceptor drum, not shown, via the transfer belt 301. Each transfer roller 370 is provided with a bearing 380 and pressed against the transfer belt 301 by a spring 390.

The black sub-frame 350 and the full-color sub-frame 360 are for simplifying engagement and disengagement of the transfer rollers 370 with/from the transfer belt 300. More specifically, in monochrome printing, the three transfer rollers 370 held in the full-color sub-frame 360 are disengaged from the transfer belt 301 altogether by an action of the full-color sub-frame 360 because these transfer rollers 370 are not used. In color printing, all three transfer rollers 370 engage the transfer belt 301 by an action of the full-color sub-frame 360.

However, in the configuration described above, replacing individual transfer roller 370 is not easy. For example, when one of the three transfer rollers 370 held in the full-color sub-frame 360 is to be replaced at the end of its useful life, it is necessary to remove the bearing 380 and the spring 390. To save trouble removing the bearing 380 and the spring 390, the full-color sub-frame 360 should be replaced with a new one, thus wasting the other two transfer rollers 370 that are still useful.

SUMMARY OF THE INVENTION

In view of the foregoing, in one illustrative embodiment of the present invention, a transfer assembly is included in an image forming apparatus including a plurality of image carriers each configured to carry a toner image. The transfer assembly includes a plurality of transferers, a supporter, and a plurality of transferer holders. The plurality of transferers is each configured to electrostatically transfer the toner image on one of the image carriers onto one of an intermediate transfer member and a recording medium. The supporter is configured to support the plurality of transferers. The plurality of transferer holders are each configured to hold one of the plurality of transferees. Each of the plurality of transferer holders and the transferer held thereby form an integrated individual unit independently attachable to and detachable from the supporter.

In another illustrative embodiment of the present invention, an image forming apparatus includes a plurality of image carriers each configured to carry a toner image thereon and the transfer assembly described above.

BRIEF DESCRIPTION OF THE DRAWINGS

A more complete appreciation of the disclosure and many of the attendant advantages thereof will be readily obtained as the same become better understood by reference to the following detailed description when considered in connection with the accompanying drawings, wherein.

DETAILED DESCRIPTION OF PREFERRED EMBODIMENTS

Figure 1:
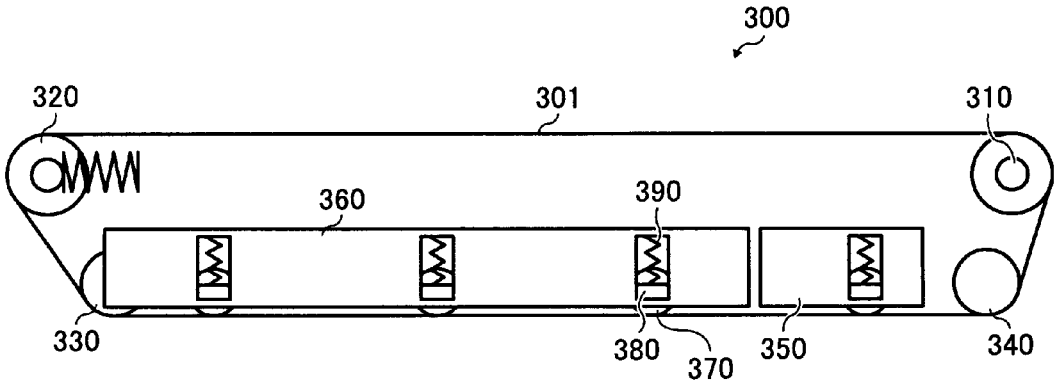
FIG. 1 RELATED ART
FIG. 1 is a schematic illustration of an example of a related art transfer belt assembly.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
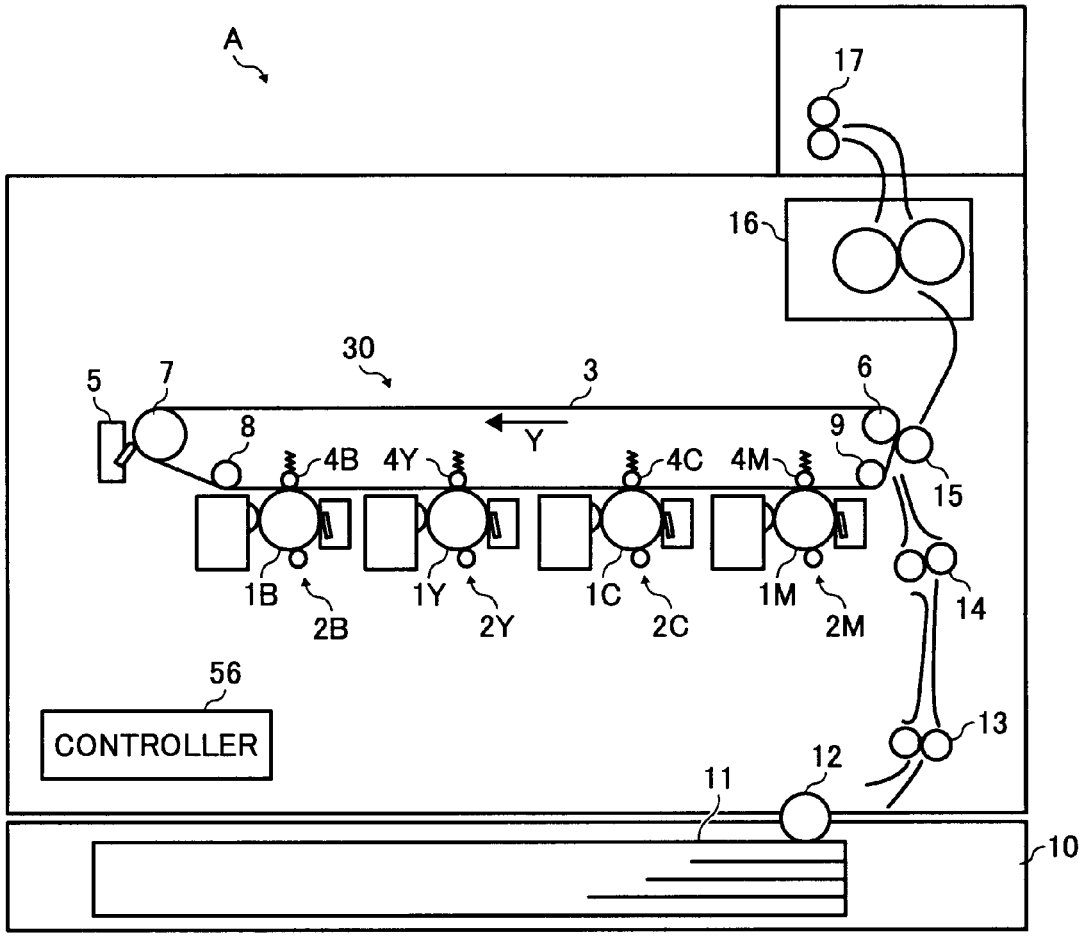
FIG. 2 is a schematic illustration of a tandem image forming apparatus according to an example embodiment of the present invention.

Referring now to the drawings, wherein like reference numerals designate identical or corresponding parts throughout the several views thereof, and particularly to FIG. 2, a tandem image forming apparatus A according to an example embodiment of the present invention is described.

Referring to FIG. 2, the image forming apparatus A includes image forming units 2B, 2Y, 2C, and 2M having photoreceptor drums 1B, 1Y, 1C, and 1M, respectively. The image forming apparatus A further includes an intermediate transfer belt 3 located to contact the photoreceptor drums 1B, 1Y, 1C, and 1M, stretched around tension rollers 6 through 9, and a transfer belt assembly 30 that is a transferee and moves the intermediate transfer belt 3 counterclockwise, that is, in a direction shown by arrow Y, in FIG. 1. The image forming units 2B, 2Y, 2C, and 2M are located sequentially from downstream in a moving direction of the intermediate transfer belt 3 (belt rotation direction), according to an order in which primary transfer is performed.

Suffixes B, Y, C, and M attached to reference numerals indicate that components indicated by those reference numerals are for forming black, yellow, cyan, and magenta toner images, respectively.

At positions facing the photoreceptor drums 1B, 1Y, 1C, and M1 via the intermediate transfer belt 3, primary transfer rollers 4B, 4Y, 4C, and 4M are provided. A power source, not shown, applies a primary transfer bias to each of the primary transfer rollers 4B, 4Y, 4C, and 4M. The image forming apparatus A further includes a cleaner 5 facing the tension roller 7 via the intermediate transfer belt 3, and a secondary transfer roller 15 facing the tension roller 6 via the intermediate transfer belt 3.

The image forming apparatus A further includes a fixer 16 located downstream from a place where the tension roller 6 and the secondary transfer roller 15 contact each other via the intermediate transfer belt 3 in a sheet transport path, and a pair of discharge rollers 17 located downstream of the fixer 16.

On the photoreceptor drums 1B, 1Y, 1C, and 1M, electrostatic latent images are formed in charge and exposure processes. The electrostatic latent images are developed with black, yellow, cyan, and magenta toners, respectively, and then transferred and superimposed one on another on the intermediate transfer belt 3 by the primary transfer rollers 4B, 4Y, 4C, and 4M, respectively. Thus, a superimposed toner image (full color image) is formed in a primary transfer process.

The image forming apparatus A further includes a sheet feeder 10, located at a bottom portion thereof, and a controller 56. The sheet feeder 10 includes a sheet cassette 11, from witch a sheet of recording media is fed by a feed roller 12, and transported through the sheet transport path by a pair of transport rollers 13 to a pair of registration rollers 14. The controller 56 includes a CPU (central processing unit), a RAM (random access memory), a ROM (read only memory), etc.

The registration rollers 14 stop the sheet, and then forward the sheet to a secondary transfer nip, which is a place where the intermediate transfer belt 3 and the secondary transfer roller 15 contact each other, such a way that the sheet overlaps the superimposed toner image. The superimposed toner image is then transferred from the intermediate transfer belt 3 onto the sheet at the secondary transfer nip in a secondary transfer process.

After the fixer 16 thermally fixes the full color image on the sheet, the discharge rollers 17 discharge the sheet from the image forming apparatus A.

As described above, the image forming apparatus A shown in FIG. 2 adopts an intermediate transfer belt method, and the transfer belt assembly 30 transfers an image on the intermediate transfer belt 3, which is an intermediate transfer member, secondarily onto a sheet by the transfer belt assembly 30.

Figure 3:
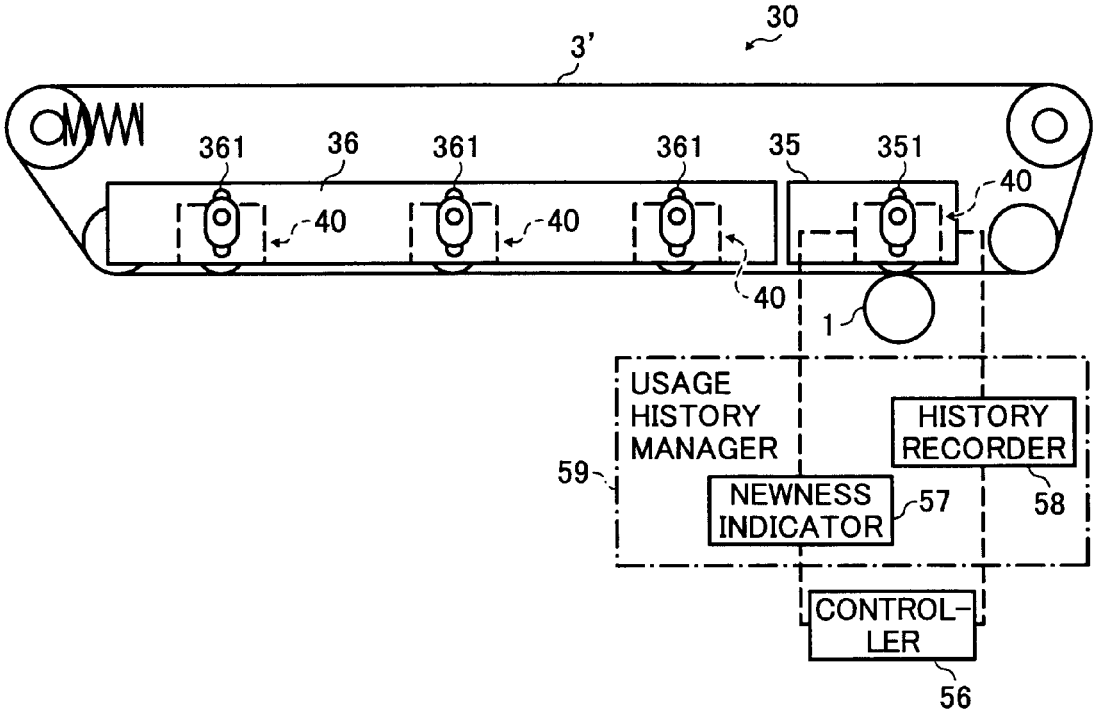
FIG. 3 is a schematic illustration of a transfer belt assembly.
Figure 4:
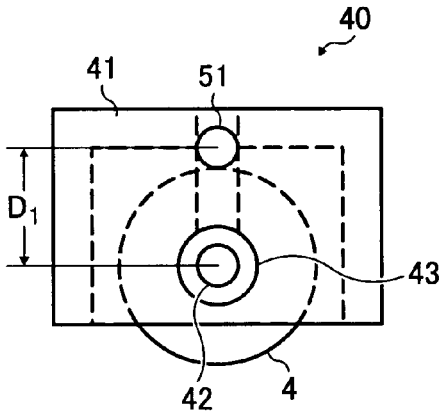
FIG. 4 shows an integrated individual roller unit for the image forming apparatus shown in FIG. 2.
Figure 5:
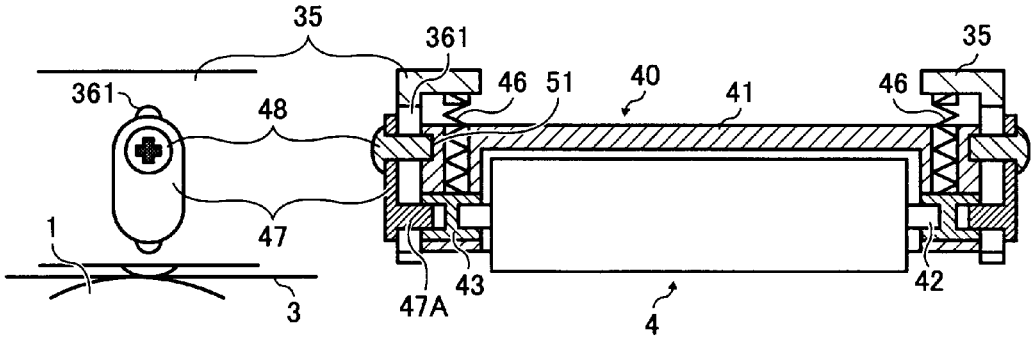
FIG. 5 illustrates a state in which the individual roller unit shown in FIG. 4 is attached to a sub-frame.
Figure 6:
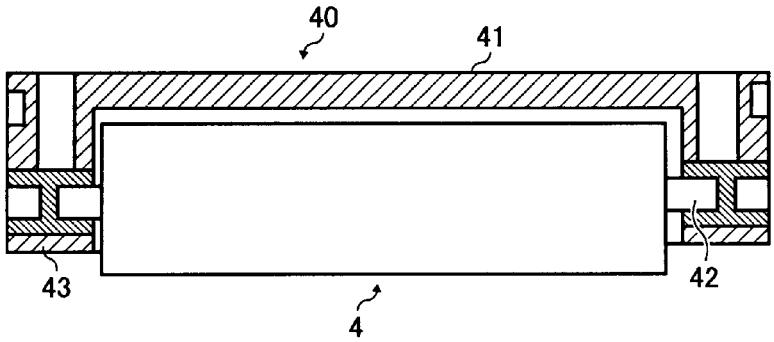
FIG. 6 illustrates the individual roller unit shown FIG. 4 detached from the sub-frame.

FIG. 3 illustrates the transfer belt assembly 30 viewed from a side opposite the the side illustrated in FIG. 2. FIG. 4 illustrates an individual roller unit 40 to be attached to the transfer belt assembly 30. FIG. 5 illustrates the transfer belt assembly 30 in which the individual roller units 40 are attached from a front and a side. Because the four individual roller units 40 have a similar configuration, the letters B, Y, C, and M to be added to the reference numerals thereof are omitted. Similarly, the letters B, Y, C, M in the reference numerals of the photoreceptor drum 1B, 1Y, 1C, and 1M and the primary transfer rollers 4B, 4Y, 4C, and 4M are omitted when distinction is unnecessary.

Referring to FIGS. 3 through 5, an example of a configuration of the transfer belt assembly 30 is described below.

As shown in FIG. 3, the transfer belt assembly 30 includes a sub-frame 35 for black and sub-frame 36 for yellow, cyan, and magenta (full color). The sub-frame 35 holds an individual roller unit 40 for black. The sub-frame 36 holds three individual roller units 40 for yellow, cyan, and magenta. More specifically, the sub-frame 35 includes a pair of side plates, facing each other, on each of which a slot 351 extending in a vertical direction in FIG. 3 is provided, and the individual roller unit 40 for black is located between the side plate. Similarly, the sub-frame 36 includes a pair of side plates, facing each other, on each of which three slots 361 extending in the vertical direction are provided horizontally, and the individual roller units 40 for yellow, cyan, and magenta are located between the side plates.

The sub-frames 35 and 36 are further described below.

As shown in FIG. 3, the image forming apparatus A further includes a usage history manager 59 in addition to the controller 56 described above that serves as a usage life manager configured to manage useful life of the individual roller units 40. The usage history manager 59 includes a newness indicator 57 and a history recorder 58. The newness indicator 57 is provided for each individual roller unit 40. When an integrated individual roller unit 40 is unused, the newness indicator 57 thereof indicates being unused (an unused state) to the controller 56. The history recorder 58 records a usage history of each individual roller unit 40.

Referring to FIG. 4, the individual roller unit 40 is described below.

The individual roller unit 40 includes a frame 41 as a holder to hold the primary transfer roller 4, a bearing 43 configured to support a roller axis 42 of the primary transfer roller 4, and a screw hole 51. Reference numeral $D_1$, indicates a distance between a center of the screw hole 51 and a center of the roller axis 42.

Referring to FIG. 5, attachment of the transfer roller 40 is described below. Although FIG. 5 illustrates one of the individual transfer rollers 40 for full color being attached to the sub-frame 36, the individual roller unit 40 for black is attached to the sub-frame 35 in a similar manner.

As illustrated in FIG. 5, each individual roller unit 40 is attached to the sub-frame 36 of the transfer belt assembly 30 shown in FIG. 3 with a step screw 48 and a plate 47. The plate 47 includes a pin 47A protruding from a back surface thereof, and a hole which the step screw 48 spinably engages.

The pin 47A on the back surface of the plate 47 penetrates the slot 361 from outside the sub-frame 36, with a tip thereof engaging the bearing 43 from a side opposite the side of the roller axis 42. The step screw 48 penetrating the plate 47 further penetrates the slot 361 from outside, with a tip thereof engaging the screw hole 51 on the frame 41 of the individual roller unit 40. With the engagement described above, the sub-frame 36 supports the individual roller units 40 for yellow, cyan, and magenta.

As illustrated in FIG. 5, springs 46 are provided on both side plates of the sub-frame 36. An end of each spring 46 is fixed at the sub-frame 36, and the other (unfixed) end thereof penetrates a hole provided on a top plate of the frame 41 and presses the bearing 43 against the intermediate belt 3 and the photoreceptor drum 1. Therefore, the springs 46 press whole the individual roller unit 40 to the intermediate belt 3 and the photoreceptor drum 1, contacting the primary transfer roller 4 with the photoreceptor drum 1 via the intermediate transfer belt 3.

The bearing 43 is electrically conductive, and the power source, not shown, applies a transfer bias to the primary transfer roller 4 through the springs 46.

According to the present embodiment, the primary transfer roller 4 and components to hold the primary transfer roller 4, such as the frame 41 and the bearing 43, form each integrated individual roller unit 40 attachable to and detachable from the transfer belt assembly 30. Further, each individual roller unit 40 is independently attachable to and detachable from the transfer belt assembly 30. Therefore, when the useful life of one of the primary transfer rollers 4 ends, only that primary transfer roller 4 need to be replaced and can be done so easily, without removing and reinstalling the bearings 43, the springs 46, etc.

Further, because the primary transfer roller 4 is not attached to and detached from the transfer belt assembly 30 singularly, a user need not hold the small roller axis 42 when detaching the primary transfer roller 4 from the transfer belt assembly 30 so as not to soil his/her hands. Further, protecting the primary transfer roller 4 with the frame 41 can prevent or reduce stains on and/or damage to the primary transfer roller 4 that are caused by hand contact or by contact with other components during replacement.

Further, cost can be reduced by integrating a replacement part and related components in a unit having a similar or identical configuration applicable to different types of image forming apparatuses. For example, in tandem type image forming apparatuses, the configuration of a unit including transfer members may differ according to type, although each transfer member and a configuration around the transfer member are similar or the same.

For example, assume that there are image forming apparatus models B1 and B2. The model B1 uses a transfer belt assembly similar to the transfer belt assembly 30 illustrated in FIG. 3, except that a primary transfer roller thereof is not attachable to or detachable from the transfer belt assembly as an integrated individual roller unit. The model B2 uses a transfer belt assembly similar to the transfer belt assembly included in the model B1, except that a pitch between primary transfer rollers thereof in the belt rotation direction is different from that of the model B1.

In these cases, when one of the primary transfer rollers for yellow, cyan, and magenta is to be replaced in each of the models B1 and B2, it is necessary to replace a whole full color unit including these three primary transfer rollers together with a sub-frame thereof. Moreover, because the pitch between the primary transfer rollers is different in the models B1 and B2, the models B1 and B2 cannot use the same type of full color unit.

By contrast, the image forming apparatus A according to the present embodiment uses integrated individual roller units 40, in each of which one primary transfer roller 4 and related components are configured as a unit. Therefore, the individual roller unit 40 can be used in common with another type of image forming apparatus, regardless of the pitch between the primary transfer rollers 4. Therefore, cost can be reduced by integrating a replacement part with related components as a common unit usable in different image forming apparatus types.

As described above, in the transfer belt assembly 30 shown in FIG. 3, one end of each spring 46 is attached to one of the sub-frames 35 and 36, and the unfixed end thereof penetrates the hole in the top plate of the frame 41 of the individual roller unit 40. Alternatively, one end of the spring 46 may be fixed on the frame 41, and the other end thereof may be set at a spring set position provided on the sub-frames 35 and 36.

In the present embodiment, the individual roller units 40 for black, yellow, cyan, and magenta have a similar configuration. Therefore, it is not necessary for a user to stock four individual roller units 40, one each for black, yellow, cyan, and magenta. As long as the user has one individual roller unit 40 in stock, when the useful life of one of four individual roller units 40 ends, the user can replace the individual roller unit 40 with the stock, regardless of color.

Because the individual roller units 40 for black, yellow, cyan, and magenta are similar to each other, the frames 41 of the individual roller units 40 also have an attachment part whose disposition pattern is similar to each other. The attachment part is a part which fasteners to fix the individual roller unit 40 to one of the sub-frame 35 and 36 engage. Although in the present embodiment the fasteners are the step screw 48 and the pin 47A on the plate 47, the fasteners may be any items that detachably attach the individual roller unit 40 to one of the sub-frame 35 and 36. The attachment part includes the screw hole 51 and the bearing 43, which the step screw 48 and the pin 47A on the frame 47 engage.

The attachment part, the screw hole 51 and the bearing 43 are provided at each of the side plates of the frame 41 facing each other. As shown in FIG. 4, the screw hole 51 and the bearing 43, which is located under the screw hole 51 in FIG. 4, are located at the distance $D_1$, on each side plate of the flame 41. The screw holes 51 on both side plates have a similar diameter and are aligned horizontally. Similarly, the bearings 43 on both side plates have a similar diameter and are aligned horizontally. That is, the disposition pattern of the attachment part is the screw holes 51 and the bearings 43 on both side plates of the frame 41 that are aligned horizontally, and the screw hole 51 and the bearing 43 on each side plate thereof are located at the distance $D_1$.

As described above, the four individual roller units 40 have a similar arrangement pattern, and positions to attach the fasteners, the step screw 48 and the pin 47A on the plate 47, are the same or similar in the four individual roller units 40. Therefore, because the four individual roller unit 40 can be attached to or detached from the transfer belt assembly 30 in a similar procedure, replacement thereof can be simplified.

Figure 7:
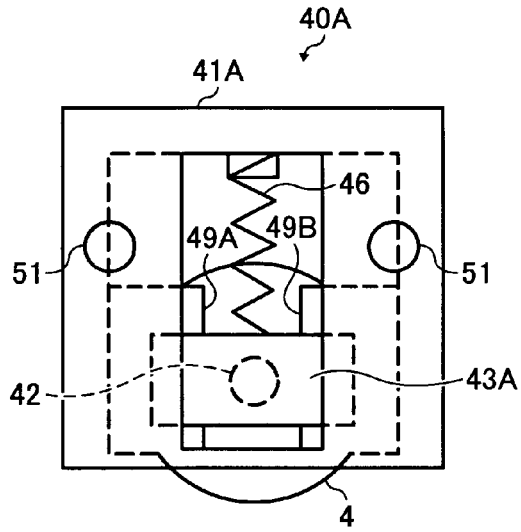
FIG. 7 is a schematic illustration of an individual roller unit for one of yellow, cyan, and magenta for the image forming apparatus shown in FIG. 2.

Referring to FIGS. 7 though 9, an individual roller unit 40A according to another embodiment of the present invention is described below. It is to be noted that, unless otherwise described, the individual roller unit 40A is used in the image forming apparatus A shown in FIG. 2 and image forming apparatuses similar thereto.

The individual roller unit 40A is for one of yellow, cyan, and magenta, and holds a primary transfer roller 4, which faces one of photoreceptor drums 1Y, 1C, and 1M shown in FIG. 2 via an intermediate transfer belt 3, therein. As shown in FIG. 7, the individual roller unit 40A includes a frame 41A, a pair of bearings 43A to hold a roller axis of the primary transfer roller 4, a pair of spring 46, two pairs of guide rails 49A and 49B, and screw holes 51. The frame 41A is a transferee holder and holds the primary transfer roller 4, the bearings 43A, the springs 46, etc. A transfer bias is applied to the primary transfer roller 4 through the bearings 43A and the springs 46.

Figure 8:
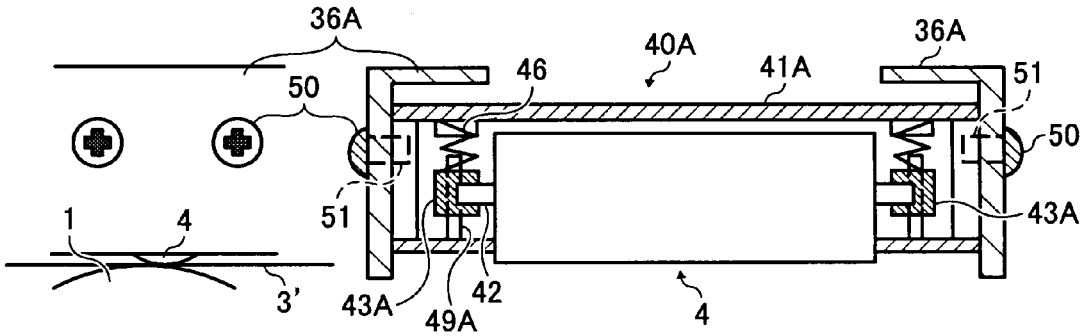
FIG. 8 is a schematic illustration of a full color sub-frame in which the individual roller unit shown in FIG. 7 is attached.

FIG. 8 illustrates a state in which the individual roller unit 40A is attached to the sub-frame 36A for full color. The individual roller unit 40A is fixed between a pair of side plates of the sub-frame 36A by screws 50, each of which penetrates the side plate of the sub-frame 36A from outside with an end thereof engaging the screw hole 51 provided in the frame 41A.

As illustrated in FIG. 8, the bearings 43A are provided at both end portions of the individual roller unit 40A in a width direction of the intermediate transfer belt 3. At each end portion, each bearing 43A, guided by one guide rail 49A and one guide rail 49B, although the guide rail 49B is omitted in FIG. 8, can move toward and away from the intermediate transfer belt 3, in a vertical direction in FIG. 8, while holding the roller axis 42 of the primary transfer roller 4. In the individual roller unit 40A, each spring 46 biases only the bearing 43A and the primary transfer roller 4 with one end thereof fixed inside the frame 41A. This arrangement is different from that of the individual roller unit 40 shown in FIG. 4 in which each spring 46 biases whole the individual roller unit 40 with one end thereof fixed on the sub-frame 36.

Figure 9:
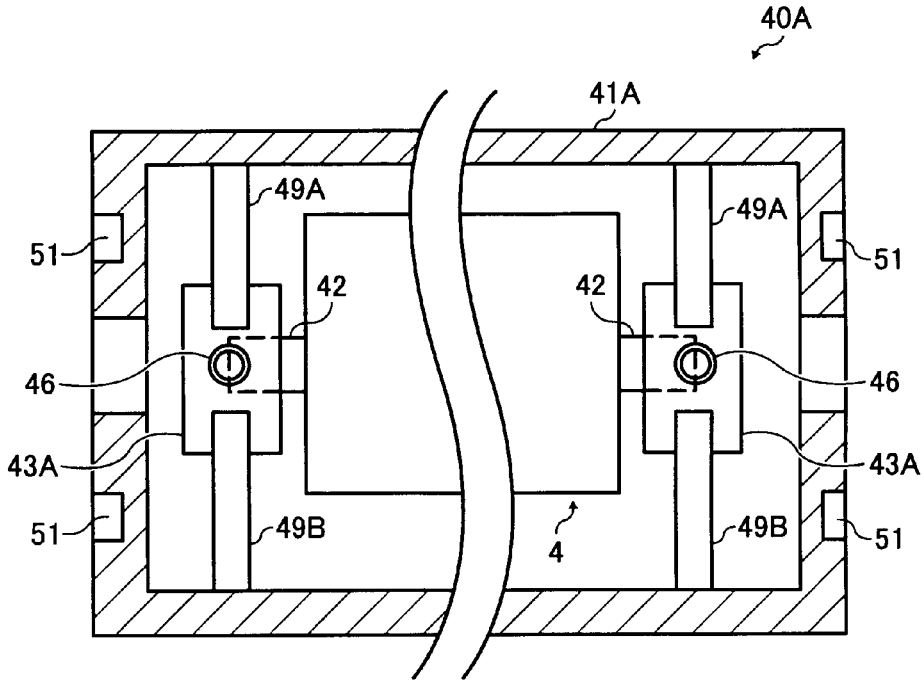
FIG. 9 is an overhead view illustrating an inner configuration of the individual roller unit shown in FIG. 7.

FIG. 9 is an overhead view of the individual roller unit 40A. As described above, each bearing 43A engages the guide rails 49A and 49B so as to be able to slide vertically. In the individual roller unit 40A, two guide rails 49A are provided in one end portion and two guide rails 49B are provided in the other end portion in the belt width direction. The guide rails 49A and 49B extend in a vertical direction, that is, a direction perpendicular to the surface of the paper on which FIG. 9 is drawn. One guide rail 49A and one guide rail 49B to face each other at a given distance.

There are several types of image forming apparatuses including a transfer belt assembly whose configuration is similar. However, a different transfer belt assembly is necessary for each type of image forming apparatus, if specification, usage condition, etc., of a transferer included in the transfer belt assembly are different.

By contrast, in the present embodiment of the present invention, a unit including a replacement part can be used in different image forming apparatus types, and thus cost can be reduced. Further, providing different integrated individual roller unit types, for example, a high quality item and a low cost item, means providing different transfer belt assembly types, and thus product line can be expanded and needs of individual customers can be satisfied.

Figure 10:
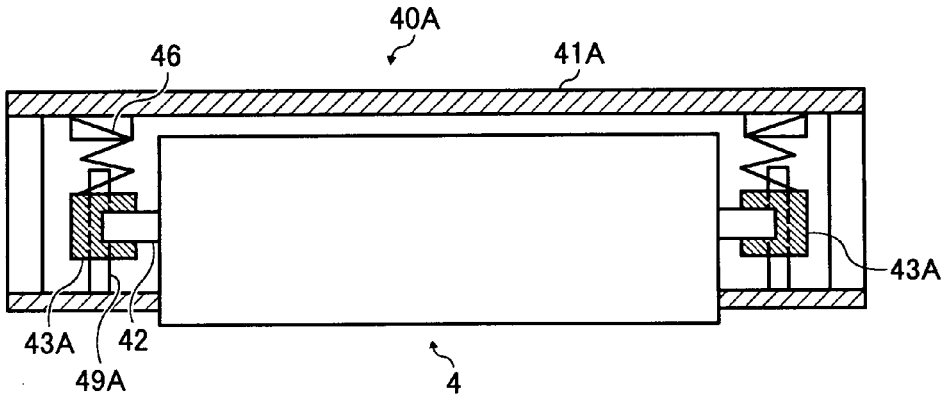
FIG. 10 illustrates the individual roller unit of FIG. 7 detached from a sub-frame.

FIG. 10 illustrates a state in which the individual roller unit 40A is detached from the sub-frame 36A. As described above, the end of each spring 46 is fixed inside the frame 41A, and thus the spring 46 biases the bearing 43A engaging the roller axis 42 and presses the primary transfer roller 4, even when the individual roller unit 40A is not attached to the sub-frame 36A.

In the configuration described above, because adjusting a position of the spring 46 between the sub-frame 36A and the frame 41A, putting the spring 46 into a hole provided on the frame 41A, etc., are unnecessary, replacement can be simplified. However, there may be a case in which a bias to a primary transfer roller (tension of a spring) differs depending on transfer belt unit type. In such a case, the same integrated individual roller unit can not be used in different transfer belt unit types. By contrast, because the spring 46 is fixed on the sub-frame 36 in the individual transfer unit 40 shown in FIGS. 4 and 5, the same configuration for the integrated individual roller unit 40 can be used in different transfer belt unit types.

Figure 11:
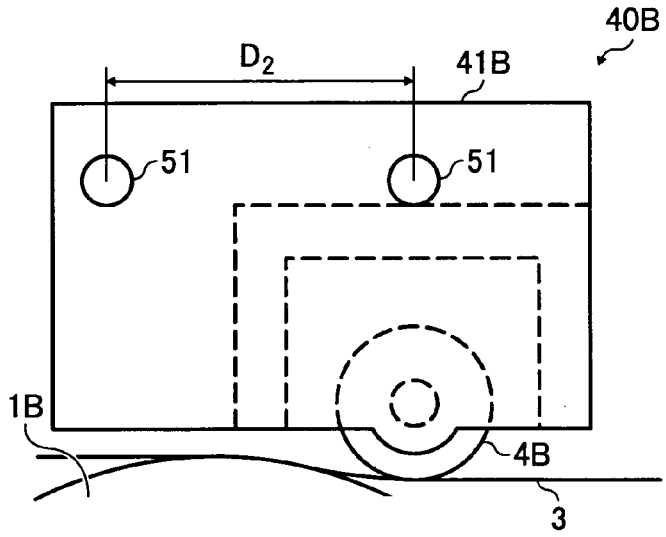
FIG. 11 is a schematic illustration of an individual roller unit for black for the image forming apparatus shown in FIG. 2.

FIG. 11 is a schematic illustration of an individual roller unit 40B for black according to the present embodiment adopting an indirect bias application method. A primary transfer roller 4B is located so as not to face a photoreceptor drum 1B vertically via the intermediate transfer belt 3, and a rotation axis of the primary transfer roller 4B is fixed, that is, a bearing fitted on the rotation axis does not slide. The individual roller unit 40B includes a frame 41B on which screw holes 51 are provided, and is attached to a sub-frame for black by screws engaging the screw holes 51.

In the individual roller unit 40A for full color shown in FIGS. 7 and 8, the primary transfer roller 4 presses the intermediate transfer belt 3 from a back surface thereof against the photoreceptor drum 1 to form a transfer nip, which is a contact area between the intermediate transfer belt 3 and the photoreceptor drum 1. The intermediate transfer belt 3 follows a track away from both the primary transfer roller 4B and the photoreceptor drum 1 immediately after passing the transfer nip.

By contrast, in the individual roller unit 40B shown in FIG. 11, the intermediate transfer belt 3 follows a track to wind around a circumference of the photoreceptor drum 1B, after passing a transfer nip and leaving the primary transfer roller 4B. In this configuration, because the primary transfer roller 4B is not pressed against the photoreceptor drum 1B in a normal line direction thereof a spring and a mechanism to move the bearing, which are for adjusting pressure against the intermediate transfer belt 3, are unnecessary, thus reducing the cost of the individual roller unit 40B.

In the present embodiment, as shown in FIGS. 7 and 11, the individual roller unit 40A for full color and the individual roller unit 40B for black have different configurations. That is, a common integrated individual roller unit is not used as both the individual roller unit 40A for full color and the individual roller unit 40B.

When individual roller units for full color and black have different configurations, disposition patterns of attachment parts thereof are typically different and thus prevent installation of the wrong individual roller unit. However, if the disposition patterns of attachment parts are different, then attachment and detachment procedures are also different, and can be hard to remember.

By contrast, in the present embodiment, the individual roller unit 40A for full color and the individual roller unit 40B for black have attachment parts whose disposition patterns are the same or substantially similar to each other. The disposition pattern has following features: The screw holes 51 on both side plates of both the frames 41A and 41B, which are aligned horizontally, have the same or substantially the same diameter. The screw holes 51 on both side plates are aligned horizontally. On each side plate of both the frames 41A and 41B, the two screw holes 51 are located horizontally at a distance $D_1$.

The attachment parts of the individual roller unit 40A for full color and the individual roller unit 40B for black have the same or substantially the same disposition pattern as well, and thus prevent installation of the wrong individual roller unit.

In the present embodiment, a concavity and a convexity that engage each other are provided on the sub-frame 36A for full color and the frame 41A of the individual roller unit 40A for full color as identification of full color. Similarly, a concavity and a convexity that engage each other are provided on the sub-frame for black and the frame 41B of the individual roller unit 40B for black as identification of black. The individual roller unit 40B for black can not be attached to the sub-frame 36A for full color, because the concavity and the convexity provided on the individual roller unit 40B and the sub-frame 36A for full color do not match. Similarly, the individual roller unit 40A for full color can not be attached to the sub-frame for black, because the concavity and the convexity on the individual roller unit 40A and the sub-frame for black do not match.

Alternatively, attachment of the wrong individual roller unit may be prevented in a control method.

Figure 12:
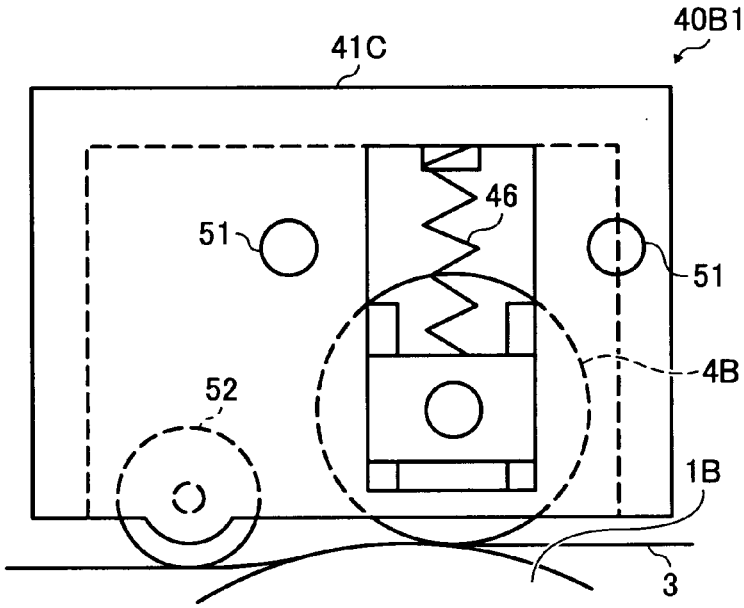
FIG. 12 is a schematic illustration of an individual roller unit for black according to another embodiment of the present invention.

FIG. 12 is a schematic illustration of an individual roller unit 40B1 for black according to another embodiment of the present invention. In the individual roller unit 40B1, a configuration around a primary transfer roller 4 is similar to that of the individual roller unit 40A shown in FIG. 7. However, the individual roller unit 40B1 further includes a roller 52 as an additional member, provided upstream of the primary transfer roller 4B in the belt rotation direction. The roller 52 enhances winding of the intermediate transfer belt 3 around the photoreceptor drum 1B, increasing a contact area (a transfer nip) between the photoreceptor drum 1B and the intermediate transfer belt 3.

The individual roller unit 40B1 is attachable to the sub-frame 36A for full color shown in FIG. 8 by screws engaging screw holes 51 on a frame 41C.

Although in a case of the individual roller unit 40B1, the roller 52 is used as a nip former, alternatively, another type of member to contact and press the intermediate transfer belt 3, such as a conductive film (e.g., Mylar™), may be used as the nip former. Further, the roller 52 may be located downstream of the primary transfer roller 4B. With the roller 52, a reliable transfer nip can be formed, and thus high quality images can be attained.

Figure 13:
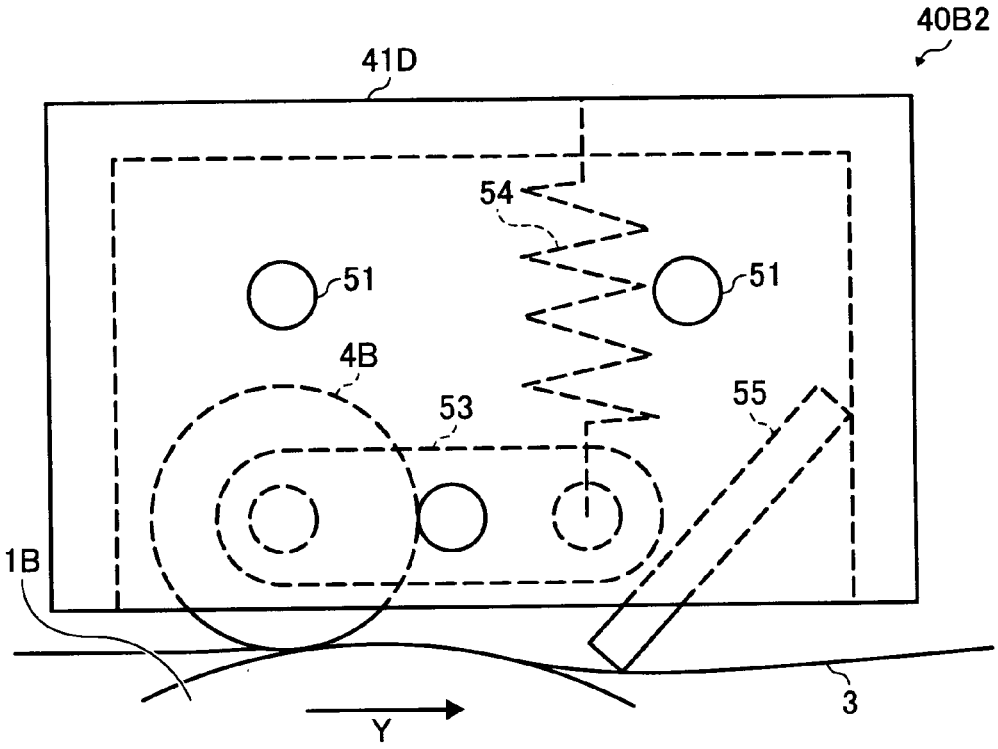
FIG. 13 is a schematic illustration of an individual roller unit for black according to another embodiment of the present invention.

FIG. 13 is a schematic illustration of an individual roller unit 40B2 for black according to another embodiment of the present invention. The individual roller unit 40B2 includes a frame 41D in which screw holes 51 are provided, a link 53 to hold a primary transfer roller 4B, a tension spring 54 to press the primary transfer roller 4B against a photoreceptor drum 1B, and a conductive film 55 as a discharger. The conductive film 55 is provided downstream of the primary transfer roller 4B in the belt rotation direction shown by an arrow Y and with an end thereof fixed in the individual roller unit 40B2. The other end of the conductive film 55 is not fixed and pressed against the intermediate transfer belt 3 from an inner surface (back surface) thereof. The individual roller unit 40B2 is attachable to a sub-frame for black by screws engaging the screw holes 51.

Referring to FIG. 13, in an area where a gap between the intermediate transfer belt 3 and the photoreceptor drum 1B is small, a discharge phenomenon may occur due to potential differences therebetween, which causes image failure, for example, partly absent toner, scattering of letters, etc., on an output image. For example, a discharge phenomenon called separating discharge occurs in a small gap between the intermediate transfer belt 3 and the photoreceptor drum 1B formed immediately downstream of an exit portion of the transfer nip, where the intermediate transfer belt 3 starts to leave the photoreceptor drum 1B, in the belt rotation direction.

Therefore, in the individual roller unit 40B2, the conductive film 55 discharges the intermediate transfer belt 3 in the small gap area, with the unfixed end thereof being in contact with the back surface of the intermediate transfer belt 3 and the fixed end thereof grounded. Thus, an occurrence of separation discharge can be prevented or reduced by preventing a transfer current from flowing to the small gap area.

It is to be noted that in an area immediately upstream from an entry portion of the transfer nip in the belt rotation direction, where the intermediate transfer belt 3 and the photoreceptor drum 1B start to contact each other, another small gap is formed (upstream gap) between the intermediate transfer belt 3 and the photoreceptor drum 1B. Accordingly, because a discharge phenomenon may also occur in the upstream gap area as well, another discharger may be provided therein.

Although the conductive film 55 is used as the discharger in the individual roller unit 40B2, the discharger is not limited thereto. Therefore, another type of discharger, such as a roller, may be provided in the individual roller unit 40B2. Further, the individual roller unit 40B2 may include a member to apply a bias to the intermediate transfer belt 3 depending on transfer conditions, not only to discharge the intermediate transfer belt 3. With the conductive film pressed against the back surface of the intermediate transfer belt 3, scattering of toner, honeycomb-shaped toner absence, etc., which occur after transferring, can be prevent or reduced, and thus high quality images can be attained.

As described above, the transfer belt assembly 30, shown in FIG. 3, according to an example embodiment of the present invention includes the individual roller unit 40 shown FIGS. 4 and 5. The individual roller unit 40 includes the primary transfer roller 4 and the frame 41 that is the transferer holder. The primary transfer rollers 4, each of which transfers an image formed on one of the photoreceptor drums 1 located along an outer circumference of the intermediate transfer belt 3, are attachable to and detachable from the transfer belt assembly 30 together with the frame 41. With this configuration, the primary transfer roller 4 can be replaced more easily, and cost can be reduced by using a common primary roller unit for any of black, yellow, cyan and magenta.

Management of the useful life of the individual roller unit 40 performed by the controller 56 is described below.

As described above, the image forming apparatus A shown in FIG. 2 includes the usage history manager 59 including the newness indicator 57 and the history recorder 58 as illustrated in FIG. 3. The controller 56 manages the useful life of the individual roller unit 40 by making the end of the useful life as a time to replace the individual roller unit 40 for each color, and it does so by tracing the usage history of that individual roller unit 40.

Specially, the controller 56 stores usage history information about each of the individual roller unit 40 in the history recorder 59, which is included in the RAM of the controller 56 in an example embodiment. The usage history information includes operating time of the individual roller unit 40 while being attached to the transfer belt assembly 30, the number of sheets printed, etc. When the operating time, the number of sheets, etc., reach a given value, the controller 56 issues a message to advise a user to replace the individual roller unit 40, determining that the useful life of the individual roller unit 40 is at an end.

When the individual roller unit 40 at the end of its useful life is replaced with another one, the usage history information in the history recorder 58 (RAM) should be reset. However, the newly attached individual roller unit 40 is not necessarily unused. Therefore, when the newly attached individual roller unit 40 is unused, the newness indicator 57, which is provided for each individual roller unit 40, indicates its being unused (unused state) to the controller 56. The controller 56 determines whether or not the newly attached individual roller unit 40 is unused by referring to the newness indicator 57 when detecting an attachment of the individual roller unit 40 to the transfer belt assembly 30. The controller 56 then resets the usage history information corresponding to the individual roller unit 40 for that color when determining that the newly attached individual roller unit 40 is unused.

By contrast, when the controller 56 determines that the newly attached individual roller unit 40 is not unused, the controller 56 informs the user of that fact, for example, by displaying a message on a display of the image forming apparatus A. The message may be a warning that the end of the useful life of the individual roller unit 40 cannot be properly predicted, as well as a query as whether or not to continue to attempt to manage the newly attached individual roller unit 40. When the user elects to manage the useful life end timing, for example, by pushing a button, the controller 56 resets the usage history information. When the user selects not to manage the useful life end timing, the controller 56 suspends managing the useful life end timing of that individual roller unit 40 until that individual roller unit 40 is replaced with another one.

Further, the configuration described above can relieve the user of renewing the usage history information manually. More specifically, when the individual roller unit 40 in the transfer belt 30 is replaced, the usage history information stored in the history recorder 58 should be renewed. If a user renews the usage history information for himself/herself, it may take some time and the user may forget to rewrite some of the information.

By contrast, in the image forming apparatus A, the individual roller unit 40 includes the newness indicator 57, and the controller 56 detects the newness indicator 57 and renews the usage history information automatically more quickly and without omission.

In an example embodiment, the newness indicator 57 is a mechanical structure. For example, the newness indicator 57 includes a specular reflector and a shutter both provided on the frame 41, and each of the sub-frames 35 and 36 includes a claw and a reflective photosensor. The shutter is slidable to an open position to expose the specular reflector and a closed position to cover the specular reflector. The shutter is at the closed position when an individual roller unit 40 is shipped to a user.

When the user removes an individual roller unit 40 at the end of its useful life from the sub-frame 35 or 36, the claw thereon opens the shutter. With the opened shutter, the individual roller unit 40 is recognizable as being used. More specifically, when the used individual roller unit 40 is attached to one of the sub-frame 35 and 36, the reflective photosensor thereon receives light reflected by the specular reflector, and thus the individual roller unit 40 is detected as being used. The controller 56 detects that an individual roller unit 40 as being unused when the reflective photosensor does not receive such reflected light.

Another management method of useful life of the individual roller unit 40 is described below.

Although life end timing of individual roller units 40 is managed for each color similarly in this method, instead of a mechanical structure, the usage history manager 59 shown in FIG. 3 is a circuit board including an integrated circuit (IC) chip and various electronic components, fixed on the frame 41.

When the transfer belt assembly 30 shown in FIG. 3 is detached from the image forming apparatus A and then reinstalled therein, the usage history manager 59 (circuit board) of the individual roller unit 40 and the controller 56 in the image forming apparatus A are electrically continuous through a contact point therebetween. In this state, the controller 56 is able to read and write information to and from the IC chip in the history manager 59.

In the usage history manager 59 as a the circuit board, both a newness indicator 57 and a history recorder 58 are included in the same IC chip. The newness indicator 57 includes newness determination information, which indicates being unused (unused state) as factory default. The newness indicator 57 further includes color identification indicating one of black, yellow, cyan, and magenta, which the individual roller unit 40 is for. When a user starts using the individual roller unit 40, the controller 56 renews the newness determination information to a value showing being used. Therefore, the controller 56 determines whether or not the individual roller unit 40 is unused based on the newness determination information stored in the newness indicator 57 in the usage history manager 59 (circuit board). Further, the controller 56 detects an error when the wrong individual roller unit 40 is attached to the image forming apparatus A based on the color identification.

As described above, in the image forming apparatus A according to the present embodiment, the individual roller unit 40 is provided with the newness indicator 57. Therefore, whether or not an individual roller unit 40 is unused and an error message indicating that the individual roller unit 40 is for the wrong color are detected through coordination between functions of the controller 56 and the newness indicator 57.

Further, in the present embodiment, the usage history manager 59 (circuit board) of the individual roller unit 40 includes the history recorder 58, and usage history information is managed through coordination between the functions of the controller 56 and the history recorder 58.

By contrast, when the history recorder 58 is included in the controller 56 with the usage history information managed only by the controller 56, the remaining life of a used individual roller unit 40 is not recognizable even if the individual roller unit 40 is detached from the image forming apparatus A before the end of its useful life. However, if the detached individual roller unit 40 is not used until its useful life ends, the individual roller unit 40 can be reused.

Therefore, in the present embodiment, by providing the individual roller unit 40 with the history recorder 58 is the form of an IC chip, etc., usage history information can be included in the individual roller unit 40, facilitating reuse or recycling of used individual roller units 40.

The usage history information stored in the history recorder 58 includes the operating time of the primary transfer roller 4 held in that individual roller unit. In this case, the useful life of the individual roller unit 40 is managed based on useful life of the primary transfer roller 4. However, in addition to the useful life of the primary transfer roller 4, the operating time of the bearings 43, the springs 46, and other components in the individual roller unit 40 may be stored so that individual component can be reused. In this case, the individual roller unit 40 is replaced with another one when one of the components reaches the end of its useful life, and other components whose operating time is relatively short can be prepared for reuse at a recycling factory.

In the example embodiments shown in FIGS. 7 though 13, the individual roller units 40B, 40B1, and 40B2 for black and the individual roller unit 40A for full color have different configuration. Alternatively, however, one of the individual roller units for full color may have a different configuration from those of the individual roller units for other colors. Or, characteristics such as electrical resistance of the primary roller unit 4, may differ among individual roller units even though appearance and/or physical structure is the same or substantially the same among the individual roller units for respective colors.

A method of determining the end of the useful life of a unit or a component is described below.

Although the end of the useful life of a component can be determined with a certain degree of accuracy by storing operating time as usage history information as in the embodiments described above, the relation between deterioration and operating time is typically different for each component. As a result, a predicted end of useful life might be slightly different from the actual end of useful life.

Therefore, in an example embodiment of the present invention, the controller 56 measures a degradation level of the primary transfer roller 4 so as to determine the end of its useful life with a higher degree of accuracy. The degradation level of the primary transfer roller 4 means the level of degradation of the conductive rubber layer included therein. The degradation level of the primary transfer roller 4 is determined based on relations among electric resistance of the conductive rubber layer, a transfer bias, and temperature, which are further described below.

The individual roller unit 40 further includes a conductive feedback current roller in addition to the primary transfer roller 4. The conductive feedback current roller is configured to contact the intermediate transfer belt 3 at a portion downstream of the primary transfer roller 4 in the belt rotation direction. The transfer current applied to the back surface of the intermediate transfer belt 3 by the primary transfer roller 4 partly flows in a thickness direction of the intermediate transfer belt 3 to the photoreceptor drum 1. This current is an actual transfer current and affects a toner image on the photoreceptor drum 1. In the transfer nip and an area around the transfer nip, the transfer current applied by the primary transfer roller 4 partly flows in a circumferential direction of the intermediate transfer belt 3, this current is hereinafter referred to as the circumferential current. A ratio of the circumferential current to the actual transfer current depends on the electrical resistance of the intermediate transfer belt 3, which changes as the temperature changes. If this ratio fluctuates, reliable transfer characteristics can not be attained.

Therefore, in the image forming apparatus A according to the present embodiment, a bias output from the power source is controlled so as to maintain the actual transfer current constant. More specifically, most of the circumferential current flows to the feedback current roller as a feedback current. The power source for supplying the transfer bias calculates the actual transfer current by deducting the feedback current from an output current, and controls the output bias to maintain the actual transfer current constant.

The image forming apparatus A further includes a temperature sensor, not shown, to detect temperature therein and output a detection result as a digital temperature signal to the controller 56. The power source to supply the transfer bias outputs a value of the transfer bias applied to the primary transfer roller 4 to the controller 56 as a digital bias signal. When the temperature signal from the temperature detector indicates a predetermined or given temperature (e.g., 25° C.), in other words, when an electric resistance of the intermediate transfer belt 3 corresponds to the predetermined or given temperature, the controller 56 reads the bias signal. The bias signal correlates with electric resistance of the conductive rubber layer in the primary transfer roller 4. That is, a transfer bias value under a given temperature increases as the electric resistance of the conductive rubber layer increases in accordance with the degradation of the conductive rubber layer. Therefore, the controller 56 determines a degradation level of the primary transfer roller 4 based on a bias signal under a given temperature, and stores the determined degradation level in the history recorder 58.

Figure 14:
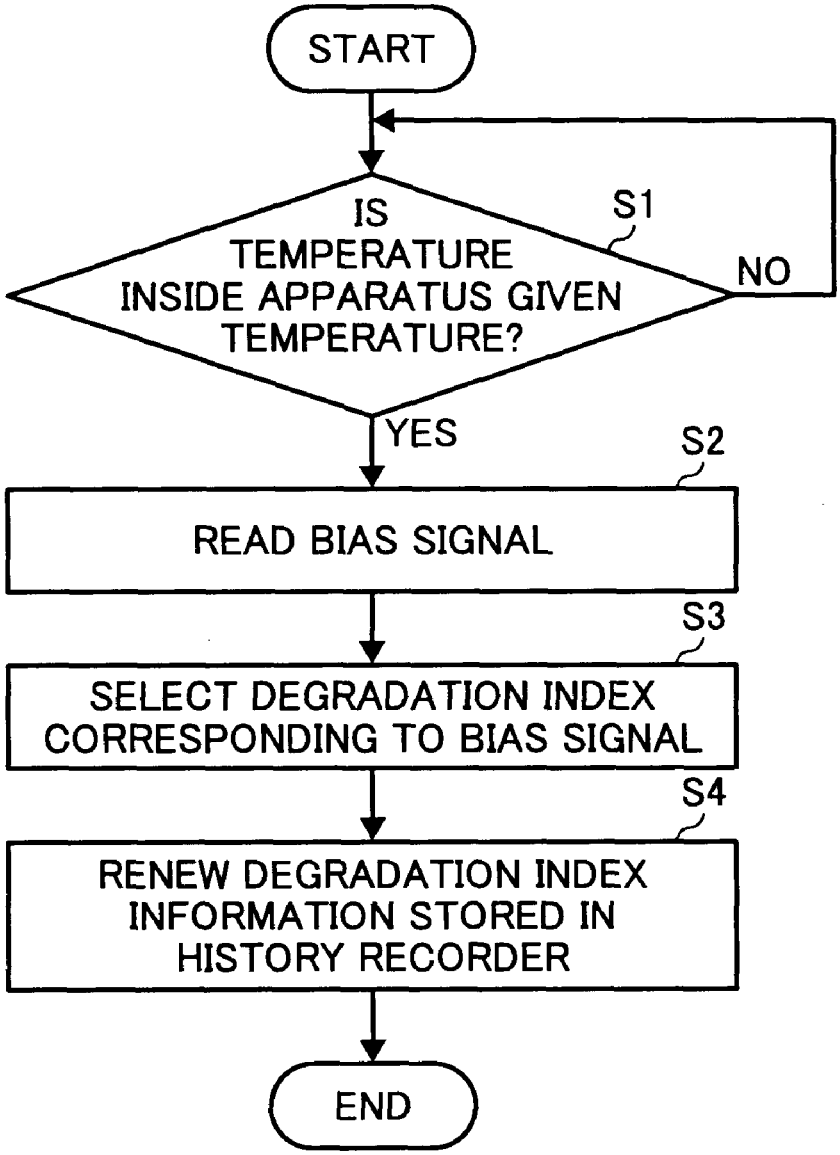
FIG. 14 is a flowchart of degradation level determination performed by a controller of the image forming apparatus according to an example embodiment.

FIG. 14 illustrates a process of degradation level determination performed by the controller 56. Referring to FIG. 14, when the controller 56 determines that the temperature inside the image forming apparatus A is a given temperature at S1 (YES at S1), the controller 56 reads a bias signal generated by the power source for supplying a transfer bias at S1. The controller 56 includes a degradation index table storing degradation indexes, which are established through tests beforehand, which are correlated with the bias signals. The controller 56 selects one of the degradation indexes from the degradation index table corresponding to the read bias signal at S3, and renews degradation index information stored in the history recorder 58 as usage history at S4.

It is to be noted that the transfer belt assembly 30 can be adopted in a tandem image forming apparatus employing a direct transfer belt method, although the description above concerns a tandem image forming apparatus employing an intermediate transfer method.

Figure 15:
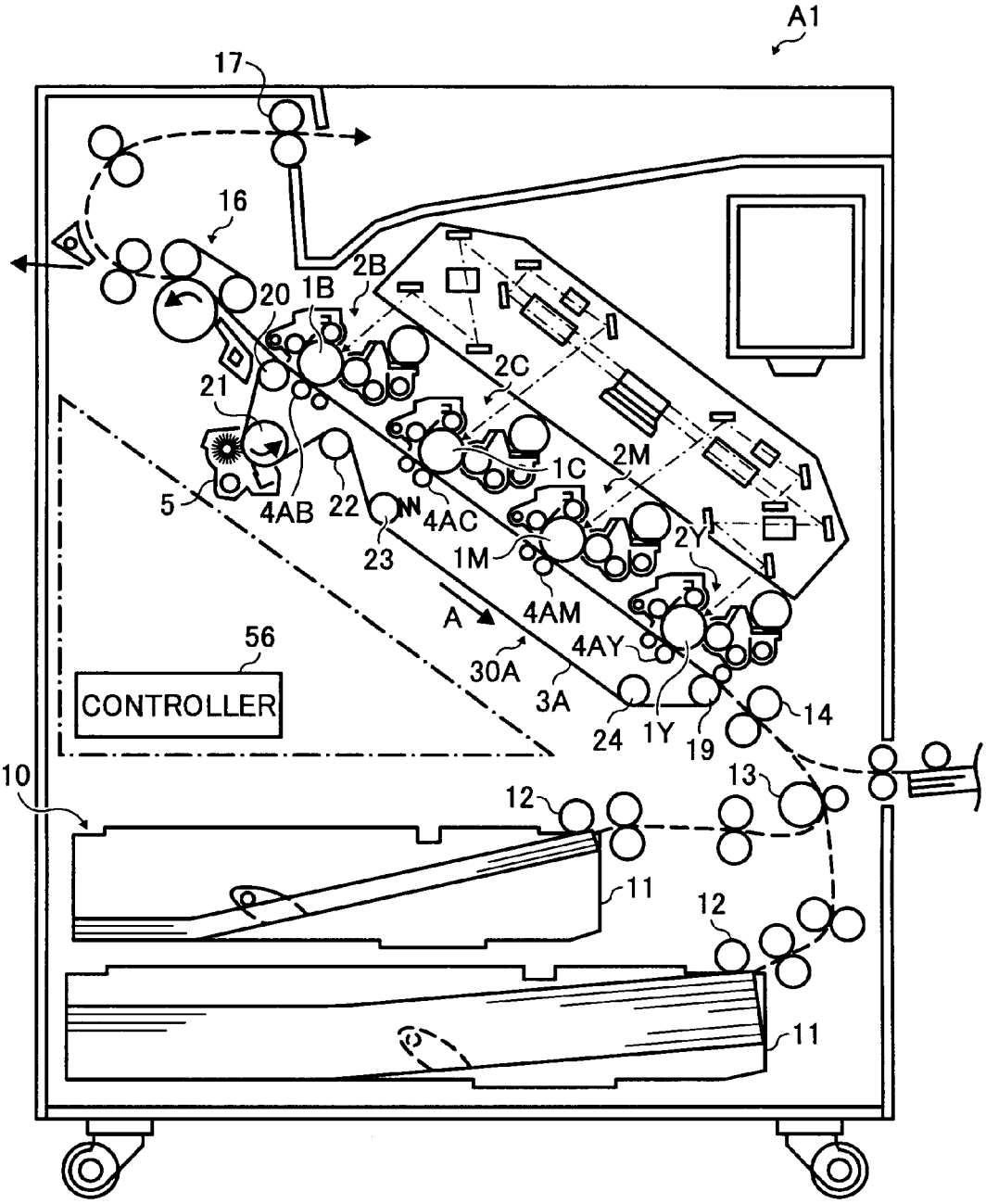
FIG. 15 is a schematic illustration of a tandem image forming apparatus according to another example embodiment of the present invention.

Referring to FIG. 15, a tandem image forming apparatus Al employing an intermediate transfer method is described below. Each component of the image forming apparatus A1 that is similar to a corresponding component of the image forming apparatus A is given the same reference numeral, and a description thereof thus omitted.

As illustrated in FIG. 15, the image forming apparatus A1 includes image forming units 2B, 2Y, 2C, and 2M having a photoreceptor drums 1B, 1Y, 1C, and 1M, respectively. The image forming apparatus A1 further includes a transfer belt assembly 30A located to contact the photoreceptor drums 1B, 1Y, 1C, and 1M. The transfer belt assembly 30A moves a transfer belt 3A stretched around tension rollers 19 through 24 counterclockwise in FIG. 15. The image forming units 2B, 2Y, 2C, and 2M are located sequentially from downstream in a moving direction of the transfer belt 3A (belt rotation direction), according to an order in which transfer is performed.

At positions facing the photoreceptor drums 1B, 1Y, 1C, and 1M via the transfer belt 3A, transfer rollers 4AB, 4AY, 4AC, and 4AM are provided. The image forming apparatus A1 further includes a cleaner 5 facing the tension roller 21 via the transfer belt 3A.

The image forming apparatus A1 further includes a fixer 16 having a heating belt located downstream of the image forming unit 2B in a sheet transport path, and a pair of discharge rollers 17 located downstream of the fixer 16. On the photoreceptor drums 1B, 1Y, 1C, and 1M, latent images are formed and developed with black, yellow, cyan, and magenta toners.

The image forming apparatus A further includes a sheet feeder 10 having a sheet cassette 11 and a feed roller 12, located at a bottom portion thereof, transport rollers 13, a pair of registration rollers 14, and a controller 56.

The toner images on the photoreceptor drums 1B, 1Y, 1C, and 1M are transferred and superimposed as a full color image on a sheet transported on the transfer and transport belt 3A. The full color image is fixed on the sheet by the fixer 16 and discharged from the image forming apparatus A1 with a pair of discharge rollers 17. Thus, the image forming apparatus A1 applies a direct transfer belt method.

As can be appreciated by those skilled in the art, although the transferer is a transfer roller in the description above, alternatively, other types of transferees, such as a transfer brush, may be used. Further, the present invention may be applied to a tandem image forming apparatus without an intermediate transfer belt or a transfer and transport belt.

Numerous additional modifications and variations are possible in light of the above teachings. It is therefore to be understood that, within the scope of the appended claims, the disclosure of this patent specification may be practiced otherwise than as specifically described herein.

What is claimed is:

1. A transfer assembly for an image forming apparatus including a plurality of image carriers each configured to carry a toner image, the transfer assembly comprising:

a plurality of transferers each configured to electrostatically transfer the toner image on one of the image carriers onto one of an intermediate transfer member and a recording medium; and a supporter configured to support the plurality of transferers; and a plurality of individual holders each configured to hold one of the plurality of transferers and including an attachment part which secures the individual holder to the supporter, a bearing to hold one of the plurality of transferers, and a frame to hold the bearing, each of the plurality of individual holders and the transferer held thereby forming a single integrated individual unit independently attachable to and detachable from the supporter with the transferer held in the individual unit.

2. The transfer assembly of claim 1, wherein the attachment part of each of the plurality of individual holders engages a fastener, and a disposition pattern of the attachment part is substantially identical for each of the plurality of individual holders.

3. The transfer assembly of claim 2, wherein the plurality of the individual holders have a substantially identical structure.

4. The transfer assembly of claim 1, wherein at least one of the plurality of individual holders supports an additional member in addition to the transferer.

5. The transfer assembly of claim 1, wherein at least one of the plurality of individual holders holds a transferer having a different characteristic from a characteristic of the transferers in other individual units.

6. The transfer assembly of claim 4, further comprising:

a plurality of tension members; and an endless belt configured to rotate while being stretched around the plurality of tension members, wherein the toner images on the image carriers are transferred onto one of a front surface of the endless belt and a recording medium carried thereon, and the additional member is a nip former configured to increase a contact area between the endless belt and the image carrier by pressing the endless belt against the image carrier.

7. The transfer assembly of claim 4, further comprising:

a plurality of tension members; and an endless belt configured to rotate while being stretched around the plurality of tension members, wherein the toner images on the image carriers are transferred onto one of a front surface of the endless belt and a recording medium carried thereon, and the additional member is a discharger configured to discharge the endless belt.

8. An image forming apparatus, comprising:

a plurality of image carriers each configured to carry a toner image thereon; and a transfer assembly according to claim 1.

9. The image forming apparatus of claim 8, further comprising a usage life manager configured to individually manage a useful life of the plurality of transferers respectively held in the individual holders.

10. The image forming apparatus of claim 9, wherein the individual units each further comprises a newness indicator configured to indicate to the usage life manager an unused state of the transferer held in the individual holder when the transferer is unused.

11. The image forming apparatus of claim 8, wherein each individual unit further comprises a history recorder configured to record usage history information of the individual unit as a whole or components included therein individually .

12. The image forming apparatus of claim 8, further comprising a history recorder configured to record usage history information of the individual unit as a whole or components included therein individually for each individual unit.

* * * * *